US009475050B2

(12) United States Patent
Leichner et al.

(10) Patent No.: US 9,475,050 B2
(45) Date of Patent: Oct. 25, 2016

(54) CONTAINER CONTAINING REFERENCE SOLUTION

(75) Inventors: Wilhelm Leichner, Mannheim (DE); Hans List, Hesseneck-Kailbach (DE); Herbert Harttig, Neustadt (DE); Axel Ahl, Mannheim (DE); Christa Sternberger, Hockenheim (DE)

(73) Assignee: Roche Diabetes Care, Inc., Indianapolis, IN (US)

( * ) Notice: Subject to any disclaimer, the term of this patent is extended or adjusted under 35 U.S.C. 154(b) by 1338 days.

(21) Appl. No.: 12/819,852

(22) Filed: Jun. 21, 2010

(65) Prior Publication Data

US 2011/0004077 A1 Jan. 6, 2011

(30) Foreign Application Priority Data

Jun. 20, 2009 (EP) ..... 09008114

(51) Int. Cl.
*B01L 3/00* (2006.01)

(52) U.S. Cl.
CPC ..... *B01L 3/523* (2013.01); *B01L 2200/0684* (2013.01); *B01L 2200/148* (2013.01); *B01L 2300/044* (2013.01); *B01L 2300/069* (2013.01)

(58) Field of Classification Search
CPC . A61M 35/003; A61M 35/006; B01L 3/508; B01L 3/50825; B01L 2200/16; B01L 2200/08; B01L 2200/04; B01L 2200/041; B01L 2200/042; B01L 2200/043; B01L 2200/044; B01L 2200/0809; B01L 2200/0832; B01L 2200/0848
USPC ..... 401/126, 127, 129, 130, 137–139, 187, 401/189, 198; 600/583, 584
See application file for complete search history.

(56) References Cited

U.S. PATENT DOCUMENTS

| | | | | |
|---|---|---|---|---|
| 3,369,543 | A * | 2/1968 | Ronco | 604/2 |
| 4,082,467 | A * | 4/1978 | Kaplan | 401/199 |
| 4,275,774 | A | 6/1981 | Andersen et al. | |
| 4,452,262 | A * | 6/1984 | Jankewitz | 132/320 |
| 4,678,754 | A * | 7/1987 | Hoskins | G01N 33/96 436/11 |
| 5,154,193 | A * | 10/1992 | Busch et al. | 132/110 |
| 5,611,687 | A * | 3/1997 | Wagner | 433/80 |
| 6,423,750 | B1 * | 7/2002 | Johnson | 514/634 |
| 6,887,709 | B2 | 5/2005 | Leong | |
| 8,066,958 | B2 * | 11/2011 | Rasch-Menges | A61B 5/14514 15/244.1 |
| 2001/0008614 | A1 * | 7/2001 | Aronowitz | A61B 10/0051 422/400 |
| 2002/0176734 | A1 | 11/2002 | Keating | |
| 2003/0211616 | A1 * | 11/2003 | Leong | B01L 3/505 436/8 |
| 2006/0263244 | A1 * | 11/2006 | Rannikko et al. | 422/58 |
| 2007/0239068 | A1 | 10/2007 | Rasch-Menges et al. | |
| 2007/0245810 | A1 | 10/2007 | Carter et al. | |
| 2008/0135559 | A1 | 6/2008 | Byrd | |

FOREIGN PATENT DOCUMENTS

| | | |
|---|---|---|
| DE | 3122237 | 5/1990 |
| FR | 2654624 | 5/1990 |
| WO | WO 02/100265 A2 | 12/2002 |
| WO | WO 2006/118843 A1 | 11/2006 |

* cited by examiner

*Primary Examiner* — Adam J Eiseman
(74) *Attorney, Agent, or Firm* — Faegre Baker Daniels LLP

(57) ABSTRACT

The present disclosure provides a container containing reference solution for clinical chemistry, whereby the container includes a closure part-covered outlet at which reference solution can be removed by puncturing with a puncturing element. The disclosure further provides a wick that is soaked with the reference solution and arranged in the container to extend from the outlet and such that a majority of its length extends into an interior space of the container.

15 Claims, 6 Drawing Sheets

CONTAINER CONTAINING REFERENCE SOLUTION

RELATED APPLICATIONS

This application claims priority to EP 09 008 114.2, filed on Jun. 20, 2009, the entire disclosure of which is hereby incorporated herein by reference.

FIELD OF THE DISCLOSURE

The present disclosure relates to a container containing reference solution for clinical chemistry, for example, a glucose solution, a lactate solution, a cholesterol solution or a hemoglobin solution.

BACKGROUND OF THE DISCLOSURE

Reference solutions of this type are needed for testing or calibration of measuring devices that are used, for example, by diabetics to determine their blood sugar level. For this reason, manufacturers of measuring systems for the determination of analyte concentrations in samples of body fluid offer containers containing reference solution in defined concentrations as part of the measuring systems.

Modern measuring devices contain a puncturing facility for taking up a sample. For example, puncturing elements with a capillary channel can be used such that a sample of body fluid can be taken up automatically when a puncture is made. Supplying reference solution to said measuring devices is associated with particular difficulties due to the small dimensions of typical puncturing elements. Attempts to drip reference solution onto a puncturing element or to apply it with a brush usually lead to contamination of the measuring device by reference solution.

For this reason, WO 2002/100265 A3 proposes a container that contains a reference solution-soaked sponge and is closed by means of a membrane. In order to take up reference solution, the measuring device is touched against the membrane and the membrane is perforated by a puncturing element. Accordingly, the reference solution is taken up in analogous fashion to a sample being taken up, namely by means of a puncturing motion of the puncturing element.

A continuous goal in the development of measuring systems is to simplify their handling and save costs. It is therefore desirable to devise a cost-efficient way of simplifying for users the supply of reference solution to measuring devices with integrated puncturing facilities without contamination.

SUMMARY OF THE DISCLOSURE

The present disclosure relates to a container configured for containing reference solution for clinical chemistry, including an outlet for extracting reference solution by puncturing with a puncturing element of a puncturing device, a closure part covering the outlet, and a wick having a length, the wick being positioned in the container and extending from the outlet such that a majority of the length extends into an interior space of the container to contact reference solution contained in the interior space.

According to one feature of the disclosure, the container includes a container wall that surrounds the wick and carries the closure part, whereby the container wall forms a stop for engaging the puncturing device during extraction of a sample of the reference solution.

According to another feature of the disclosure, the container is configured to withstand a press-against force of at least 3 N when the puncturing device engages the container during extraction of the sample without reference solution being forced from the outlet.

According to another feature of the disclosure, the closure part is connected to the container by a pre-determined breakage zone.

According to another feature of the disclosure, the container includes a pressure compensation channel that is closed by the closure part and extends into the interior space adjacent to the wick.

According to another feature of the disclosure, the wick is arranged in a channel formed by a channel wall of the container, whereby the majority of the length of the wick touches against the channel wall.

According to another feature of the disclosure, the closure part is removable and the wick is positioned in the container to project from the container, when the closure part is removed, by a distance that is smaller than a width of the wick.

In another embodiment, the disclosure provides a container including at least one wall element defining an interior space, a membrane that divides the interior space into a first chamber containing a reference solution for clinical chemistry and a second chambercontaining air, and an opening formed in the at least one wall element to effect pressure compensation between the second chamber and an exterior of the container.

According to one feature of the disclosure, the container further includes a body positioned in contact with the reference solution in the first chamber.

According to another feature of the disclosure, the container is assembled from two wall elements that are mechanically coupled to each other.

According to another feature of the disclosure, the two wall elements are movable relative to each other, and one of the wall elements carries a mandrel that points at the membrane.

The present disclosure further relates to a system for measuring an analyte concentration in a sample of a human or animal body fluid, that includes a container as described above and a measuring device that contains a puncturing facility for taking up the sample. The present disclosure also relates to a procedure for taking up reference solution with a puncturing element.

Arranging a wick in a container containing reference solution allows both the effort involved in manufacturing to be reduced and the handling by the user to be simplified significantly. This is the case because a wick can be used to provide reference solution at the outlet regardless of the filling level of the container such that reference solution can be taken up by a puncturing element of a puncturing device that punctures into the wick. Therefore, large tolerance can be tolerated while filling reference solution into the container such that the container is partly filled with air. This is the case, since it is not detrimental if the interior space of the container is partly filled with air. Capillary forces of the wick ensure that the wick is soaked with reference solution over its entire length.

The container known from WO 2002/100265 A3, on the other hand, contains a reference solution-soaked sponge and is closed by a membrane. The known container must not contain any air since a puncturing element hitting an air bubble during the puncture might take up no or an insufficient amount of reference solution. However, avoiding air bubbles or unfilled hollow spaces in a container while filling it with liquids necessitates a substantial technical effort. Moreover, the known container is associated with the hazard of the liquid being under a positive pressure due to thermal expansion such that reference solution exits and contaminates the measuring device upon perforation of the membrane. The risk of this
hazard may be reduced with a container according to the present disclosure.

Using a container according to the present disclosure, the sample can be taken up with particularly high reliability. This is based on the fibers of a wick extending substantially in the direction of the puncturing motion performed by a puncturing element in order to take up reference solution. For this reason, along its entire length that is immersed into the wick, the puncturing element is surrounded by the reference solution that is held between the fibers of the wick by capillary forces. Therefore, the active length of the puncturing element for taking up sample is maximal. This is unlike known containers, in which sponges or similar porous bodies are arranged. In a sponge or a porous body, only the part of the puncturing element that extends within the pores of the sponge can contribute to sample take-up, whereas a part of the puncturing element that is surrounded on all sides by sponge material does not contact the reference solution.

The wick can lie loosely in the container. However, it is preferred for the wick to be secured to the container. For example, the wick can be connected to a container wall in a firmly bonded fashion. Material connections like welding or by means of an adhesive are suitable.

In one embodiment of the disclosure, the container comprises a container wall that surrounds the outlet and carries the closure part, whereby the container wall forms a stop to be touched to a puncturing device for taking up a sample. By this means, reference solution can be prevented from being forced out of the container by pressure that is applied when a puncturing device is touched against the container for extracting a sample. This reduces the likelihood that reference solution that is forced out might contaminate the puncturing device and falsify future measurements. Relatively rigid-walled container walls can be used to form a stop such as is common in vials made of plastic material. In particular, wall thickness of 1 mm and more are suitable.

However, a stop can be formed also with substantially smaller walls, for example by arranging a ring surrounding the wick inside the container. When a sample is being taken up, the container wall surrounding the outlet rests on the ring and is supported by the ring such that the container wall can form a robust stop regardless of the thickness of the wall.

The container preferably withstands a press-against force of at least 3 N when a puncturing device is touched against it for taking up of a sample without reference solution being forced out of the outlet. Usually, a user applies a force of 3 Newton to 9 Newton when touching a puncturing device against a container containing reference solution. A container should be able to withstand this force also without reference solution being forced out of it by this means when the container is open.

Preferably, the fibers forming the wick are distributed evenly across its cross-section. In such an embodiment, a sample can be taken up with the same reliability regardless of where on the front surface of the wick the puncture is made.

Similar to the wick of a candle, the wick of a container according to the invention can consist of intertwined fibers. However, said intertwining is not necessary. In particular, a fiber bundle can also be used as wick. For example, the fiber bundle can project from the outlet into the interior space of the container like the bristles of a brush. The fiber bundle can be fixed in a channel, whereby the wick touches against a channel wall along a majority of its length, preferably essentially its entire length. The channel can, for example, be formed by a tube that projects into the interior space of the container. It is feasible just as well for the wall of the channel to be the interior container wall.

The closure part of a container according to the disclosure can, for example, be provided in the form of a membrane. It is also feasible to provide the container to be re-closable and use, for example, a screw closure as closure part. However, it is preferable for the closure part to be connected to the container via a predetermined breaking zone. By this means, the closure part can form a seal whose intactness ensures that the reference solution actually has the expected concentration and has not been adversely affected by damaging environmental influences. For example, the closure part and a container wall surrounding the outlet can be provided in the form of a single part, preferably as an injection molded part. The closure part may be attached to the container such that it can be twisted off, for example by providing it with two wings. However, it is feasible just as well to provide the closure part such that it breaks off the container by a buckling motion.

In the case of a closure part that is provided integrally with the container, it is preferred for the closure part to be smaller than the rest of the container. However, it is feasible just as well to provide the closure part to be larger than the container and to also have an interior space in which reference solution is present. In the context of the present disclosure, the container is defined by the wick being attached to it. When the closure part is taken off the container, the wording used in the context of the present disclosure allows for clear recognition of which part is to be considered to be the container and which part to be the closure part.

The container preferably forms a stop against which a puncturing device touches while taking up reference solution. For example, the outlet can be formed on a neck of the container, in particular by shaping the container similar to a bottle. The part of the container that is adjacent to the neck as seen from the outlet can advantageously form the stop.

Since only a very small amount of reference solution is required for testing or calibrating a measuring device, a container according to the disclosure can also be provided, for example, in the form of a tube that is closed on one end by a base and comprises, at its other end, the outlet from which the wick extends into the interior space of the container. In the case of a container of this type, a neck on which the outlet is arranged can be provided between the container and a closure part as a pre-determined breakage point. However, it is feasible just as well to provide the outlet in the form of a recess in a container wall into which a puncturing device is inserted for the removal of reference solution. A recess of this type can be shaped, in particular, to match the shape of a puncturing device such that outlet and puncturing device fit each other like lock and key.

In a container according to the disclosure, the outlet is provided as a container opening that is covered by the closure part and in which the wick is arranged. The wick can obstruct this opening such that even if there is positive pressure in the interior space of the container there is little risk of reference solution splashing from the container when the closure part is removed. In order to reduce this low risk, a pressure compensation channel that is closed by the closure part can be provided next to the wick. For example, another opening through which gas can exit from the interior space of the container as soon as the closure part is removed can be present next to the opening obstructed by the wick.

With the closure part taken off, the wick can project slightly from the container and therefore from the outlet. Preferably, with the closure part taken off, the wick projects from the container by no more than a length that is smaller than the width of the wick. In a wick that is approximately cylindrical in shape, its width is equal to its diameter. In general terms, the width of the wick is its largest extension perpendicular to its longitudinal direction. Along the majority of its length, the wick is arranged between the outlet and a container base, in particular between the pre-determined breaking point, by means of which the closure part is secured to the container, and the container base. It is particularly preferred for the wick to be arranged to be completely inside the container.

Another feature of the present disclosure provides the wick to be arranged in a channel, whereby the wick touches against a channel wall over a majority of its length. In this context, it is preferred for the wick to project from the channel by maximally a length that is smaller than its width. The channel can keep together the fibers forming the wick such that liquid can be kept between the fibers and transported by means of capillary forces. In this context, it is preferred for the channel to taper towards the removal point. The density of the wick increases from the interior space of the container towards the removal point.

Another aspect of the present disclosure relates to a container containing reference solution for clinical chemistry, whereby the container comprises an interior space that is subdivided into two chambers by a membrane. One of the two chambers contains the reference solution, whereas the other chamber is filled with air, whereby at least one container opening effects pressure compensation between the air-filled chamber and the surroundings of the container. By this means, the pressure in the chamber containing reference solution can be made to deviate no more than insignificantly from the atmospheric pressure of the surroundings of the container. Accordingly, when the chamber containing reference solution is punctured, there need be no fear of a substantial amount of reference solution leaking and contaminating the measuring device.

The outlet of a container of this type can be closed by means of a membrane as closure part with the membrane being perforated with a puncturing element for removal of reference solutions. Preferably, a body that is soaked in reference solution, in particular a wick, is arranged on said outlet. A wick of this type preferably extends, as illustrated above, from the outlet into the interior space of the container, to be more precise, into the chamber containing reference solution.

Another aspect of the present disclosure relates to a container containing reference solution for clinical chemistry, whereby the container contains a reference solution-soaked body and comprises a stop for touching against a puncturing device for removing a sample. The stop can take up a pressure that is exerted by a puncturing device being touched against it without the pressure on the inside of the container being increased sufficiently for reference solution to be forced out of the container. Accordingly, a stop reduces the risk of contamination of the puncturing device.

In the case of a rigid-walled container, the stop can easily be formed by the container walls. In the case of a thin-walled container, for example a film bag, a ring-shaped disc surrounding the reference solution-soaked body can be arranged in the container. A ring-shaped disc of this type can support a container wall that covers it such that the wall section covering the ring-shaped disc can be used as stop. A container with a stop can also be formed as a blister (i.e., a container with a base plate on which a film or foil is attached such that an interior space of the container is formed between the film or foil and the base plate). In this context, the stop can be formed by an area of the base plate that surrounds the interior space of the container. Pressure acting on the base plate in an area that surrounds the interior space of the container does not lead to an increase of the pressure in the interior space of the container.

A reference solution-filled container and a measuring device containing a puncturing facility for taking up sample together form a measuring system. In this context, the container can contain, for example, 100 μl to 200 μl of reference solution.

BRIEF DESCRIPTION OF THE DRAWINGS

Further details of the present disclosure are illustrated based on embodiments and by making reference to the appended drawings, wherein.

Identical and equivalent components are identified with consistent reference numbers.

DETAILED DESCRIPTION OF EMBODIMENTS OF THE DISCLOSURE

Figure 1:
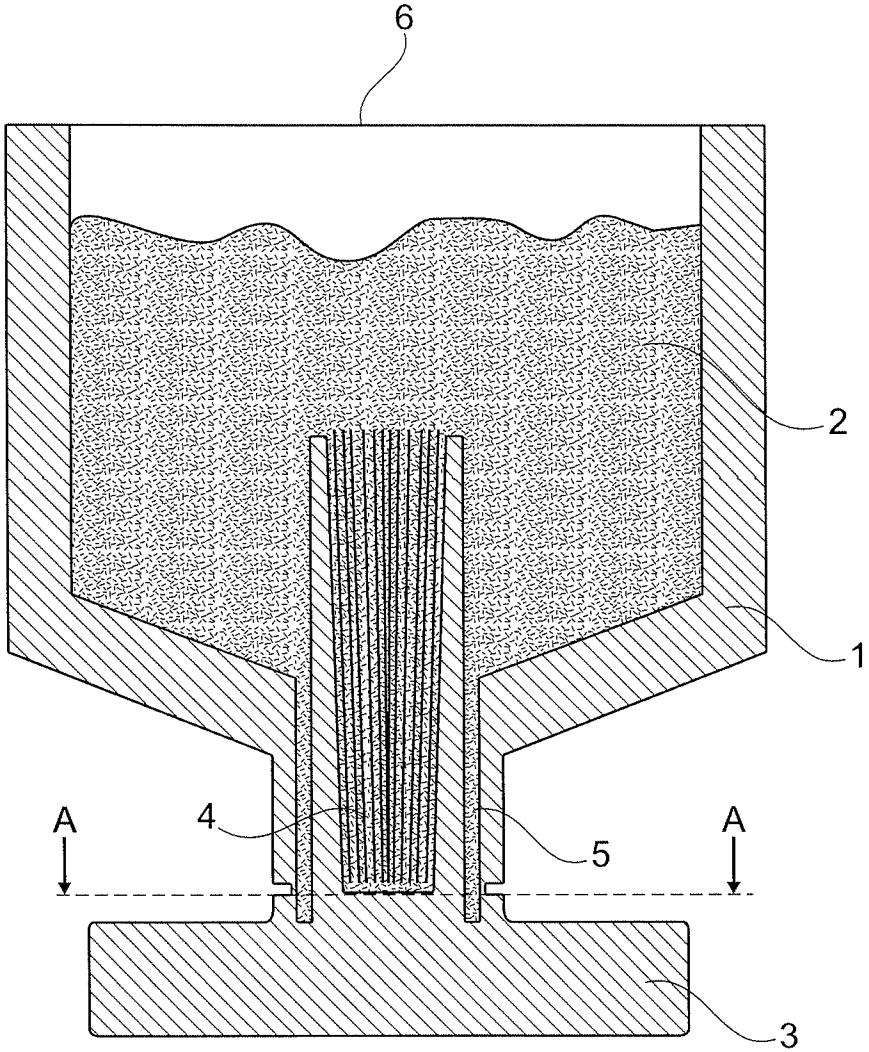
FIG. 1 shows a schematic view of a longitudinal section of a container according to one embodiment of the disclosure.

FIG. 1 shows a longitudinal section of a container 1 that contains reference solution 2 for clinical chemistry, for example glucose solution, in an interior space. The container is closed by means of a closure part 3. The closure part 3 covers an outlet from which a wick 4 extends into the interior space of the container 1. For removal of reference solution 2, the closure part 3 is taken off the container 1 and a puncturing element is punctured into the outlet thus exposed and therefore into the wick 4. In the process, a puncturing device is touched against a stop that is formed by a container wall that surrounds the wick 4 and therefore also the outlet. The container walls are sufficiently stable to be able to withstand a force of at least 3 N, which is typically exerted by pressing a puncturing device against the stop, without reference solution 2 being forced out of the container 1.

The wick 4 is formed by a fiber bundle that is arranged to be fully inside the container 1. One end of the fiber bundle 4 is arranged in the outlet (i.e., in the container opening that is formed by removing the closure part 3), and secured to the container 1 in this place. The other end of the wick 4 is arranged inside the reference solution 2-containing interior space of the container 1 and immerses into the reference solution 2 when the container 1 is oriented such that its outlet faces upwards. The fibers of the wick 4 extend in the longitudinal direction thereof.

The wick 4 is secured on, or inside to be more precise, the container 1 by the wick 4 being arranged in a channel and touching against the channel wall along the majority of its length. The wick 4 is secured to the channel wall, preferably by being welded to the channel wall. The channel is provided in the form of a tube that extends into the interior space of the container 1 in the embodiment shown. The channel containing the wick 4 tapers towards the removal point (i.e., the outlet), for example, by the interior space of the channel being provided to be conical in shape.

The closure part 3 is connected to the container 1 via a pre-determined breakage zone. The pre-determined breakage zone can, for example, be provided as a circumferential constriction. In the embodiment shown, the closure part 3 is provided to be twisted off or snapped off and thus has two wings that simplify the application of a torque for a user.

Figure 2:
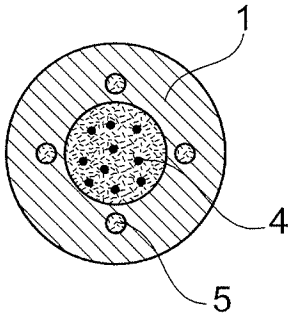
FIG. 2 shows a cross-section taken along line A-A of FIG. 1.

FIG. 2 shows a cross-sectional view with respect to FIG. 1 along the section line A-A. FIG. 2 therefore also shows a top view onto the outlet of the container 1 with the closure part 3 taken off. As is evident therefrom, the wick 4 fills a container opening that is covered by the closure part 3 in FIG. 1. The fibers forming the wick 4 are distributed evenly over the cross-section thereof.

Adjacent to the wick 4 are situated one or more pressure compensation channels 5 which are also closed by the closure part 3. When the closure part 3 is taken off the container 1, gas can exit from the interior space of the container 1 or air can enter into the interior space of the container 1 through the pressure compensation channel 5 such that any positive or negative pressure that may be present is compensated. The wick 4 and its fibers extend in the direction of the pressure compensation channel 5.

As shown in FIG. 1, the interior space of the container 1 that contains the wick 4 and the reference solution 2 is partly filled with air. The wick 4 extends from the outlet into the interior space of the container 1 far enough for the wick 4 to immerse into the reference solution 2 when the outlet faces upwards. For this reason, the wick 4 is soaked with reference solution 2 over its entire length such that reference solution 2 can be removed even by a very short puncturing element puncturing into the wick 4 that is arranged in the outlet. In order to increase the capillary effect of the wick 4, a surfactant can be added to the reference solution 2 such that its surface pressure is reduced.

The container 1 can have a base made of a sheet 6, for example film and/or foil. By this means, a main part of the container 1 and the closure part 3 can be made of plastic as an injection molded part (i.e., in the form of a single piece), and subsequently the wick 4 can be inserted and the reference solution 2 added. Subsequently, a sheet 6 can be glued onto the main part of the container and the latter can thereby be closed.

The base 6 can, for example, be a plastic-coated metal foil, for example a plastic-coated aluminum foil. Advantageously, the sheet 6 can be glued to the main part of the container 1 and a batch information, for example the expiration date, can be printed on it.

Instead of a sheet 6, a main part of the container 1 can, for example, be closed by its lower edges being connected to each other like in a collapsible tube, for example by gluing or welding, after addition of the reference solution.

Figure 3:
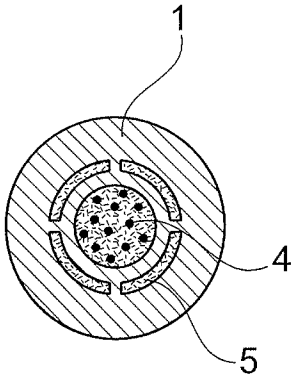
FIG. 3 shows a schematic view of a cross-section similar to that of FIG. 2, but for another embodiment of a container.

FIG. 3 shows another embodiment of a container 1 containing reference solution 2 in the form of a cross-section according to FIG. 2. The sole difference to the preceding embodiment is that the pressure compensation channels 5 that extend adjacent to the wick 4 take a different shape.

Figure 4:
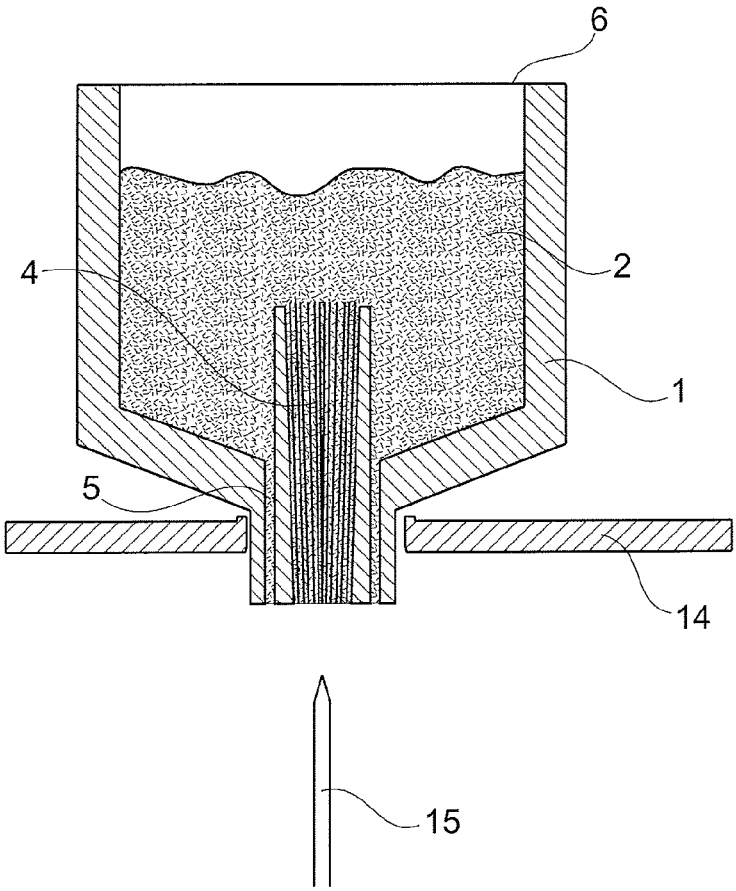
FIG. 4 shows the embodiment of FIG. 1 during the removal of reference solution.

FIG. 4 schematically shows the removal of reference solution 2 from the container 1 shown in FIG. 1 by means of a puncturing element 15. For removal, the housing 14 of a puncturing device is touched against the container 1 such that reference solution 2 can be taken up by puncturing into the wick 4. FIG. 4 shows the container 1 during the removal of reference solution 2 with its outlet facing downward such that the puncturing motion performed by the puncturing element 15 proceeds in upward direction. However, the container 1 may be in any orientation for removal of a sample.

Figure 5:
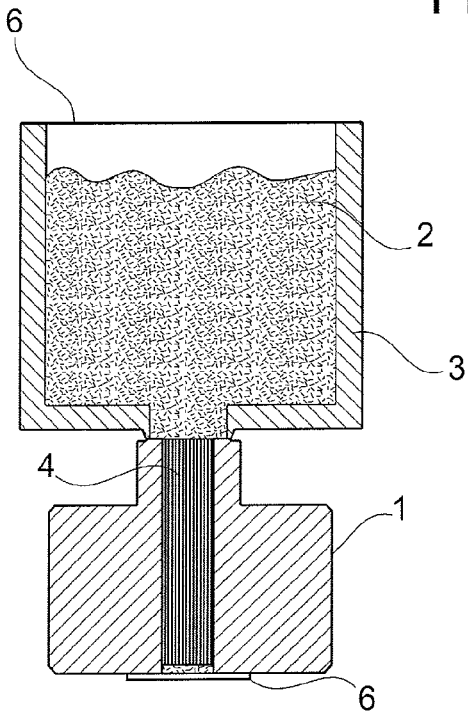
FIG. 5 shows a schematic view of a longitudinal section of another embodiment of the present disclosure.
Figure 6:
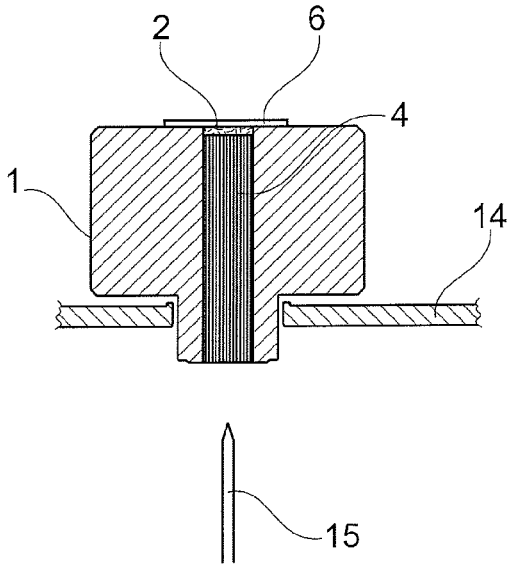
FIG. 6 shows the embodiment of FIG. 5 during the removal of reference solution.

FIG. 5 shows another embodiment of a container 1 containing reference solution 2. Similar to the preceding embodiments shown, a closure part 3 is connected to a container by means of a pre-determined breakage point in this embodiment. However, the closure part 3 in this embodiment is larger than the container 1 containing the wick 4. For this reason, the closure part 3 in this embodiment also has an interior space that contains reference solution 2 and a base that is closed by film/foil 6. This embodiment shows for the purposes of the present invention that the container 1 is defined by its feature of the wick 4 being secured to it. FIG. 6 shows schematically how a puncturing element 15 is punctured into the wick 4 for removal of a sample.

Like in the preceding embodiments shown, the outlet is arranged on a neck of the container. In this manner, the container 1 forms a stop for the device housing 14 that is touched against the container 1 for removal of a sample.

Figure 7:
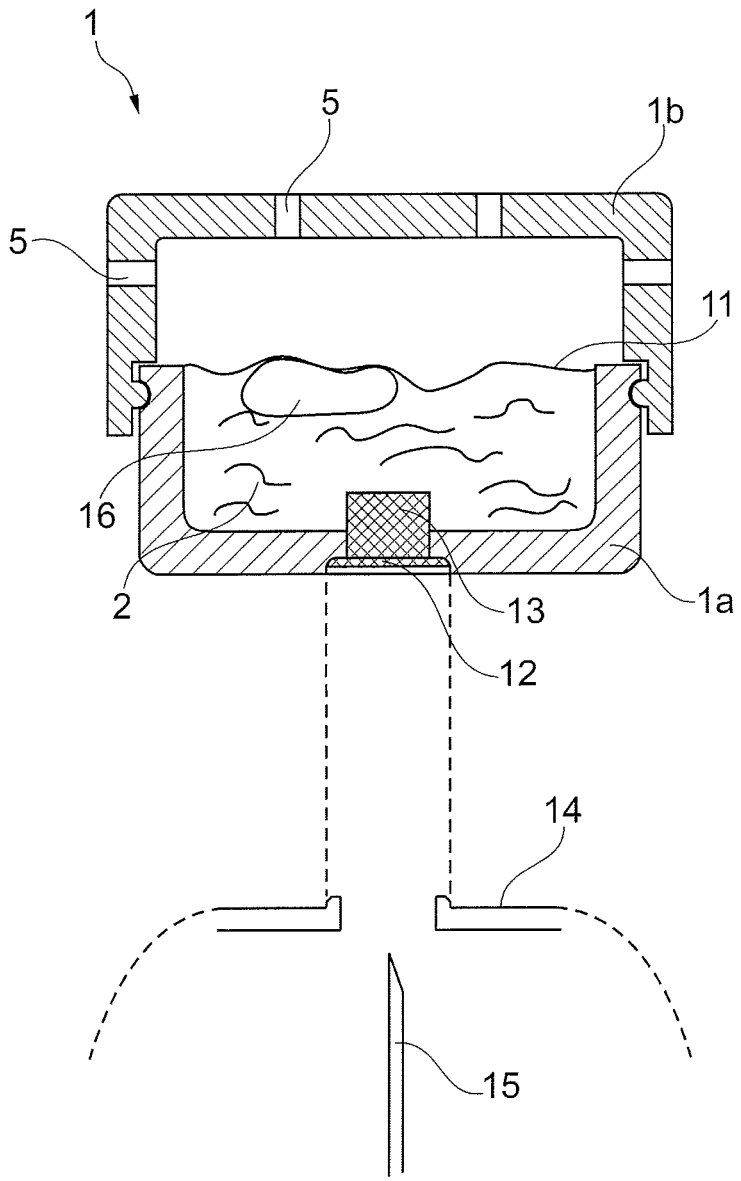
FIG. 7 shows a schematic view of a longitudinal section of another embodiment of the present disclosure.

FIG. 7 shows another embodiment of a container 1 containing reference solution 2 for clinical chemistry, for example a glucose solution, a lactate solution, a cholesterol solution or a hemoglobin solution. The container 1 is assembled from two wall elements 1*a*, 1*b* plugged into each other and has an interior space that is subdivided into two chambers by a membrane 11. One of the two chambers contains reference solution 2 to which a surfactant can been admixed, whereas the other chamber is filled with air. Container openings with pressure compensation channels 5 that extend through the wall element 1*b* effect pressure compensation between the air-filled chamber and the surroundings of the container.

The chamber containing reference solution 2 can be filled fully or partially (i.e., also contain air aside from reference solution), which is indicated in FIG. 7 by means of an air bubble 16. This chamber has an outlet that is closed by a closure part, namely a membrane 12. A reference solution 2-soaked body, for example a sponge 13, is arranged on the outlet.

For removal of reference solution 2, a puncturing device 14 can be touched against the outlet, which is closed by the membrane 12, and the membrane 12 can be perforated using a puncturing element 15 that comprises a sample take-up facility, for example a capillary channel. However, it is feasible just as well to remove the membrane 12 from the outlet prior to a puncture. The membrane 12 can, for example, be provided in the form of a sealing film/foil. In particular, the membrane can be a metal foil that is preferably coated with plastic.

The outlet of the container 1 is provided to match the shape of the puncturing device 14 in order to make it easier for users to correctly touch the puncturing device 14 against the membrane 12 in order to remove reference solution 2.

The membrane 12 can comprise a hydrophobic surface. By this means, reference solution 2 can be prevented from exiting the container 1 on its own accord and causing contamination after perforation of the membrane 12.

Preferably, the two container parts 1*a*, 1*b* are rigid-walled. Wall elements 1*a*, 1*b* of this type can be manufactured at beneficial prices for example as injection-molded parts made of plastic material. Taken together, the wall element 1*a* and the membrane 11 form a container that contains the reference solution 2. The function of the container part 1*b* is to protect the membrane 12 from damage. Preferably, the two wall elements 1*a*, 1*b* are locked to each other. This allows the effort in manufacturing to be reduced.

In order to attain the desired pressure compensation between the air-filled chamber and the surroundings of the container 1, a single opening with a pressure compensation channel 5 is basically sufficient. However, it is preferred for multiple openings with pressure compensation channels 5 to be present, like in the embodiment shown. There is no harm done if a user covers some of the openings 5 with pressure compensation channels 5 while handling the container 1, because just a single uncovered opening with a pressure compensation channel 5 enables sufficient pressure compensation.

Figure 8:
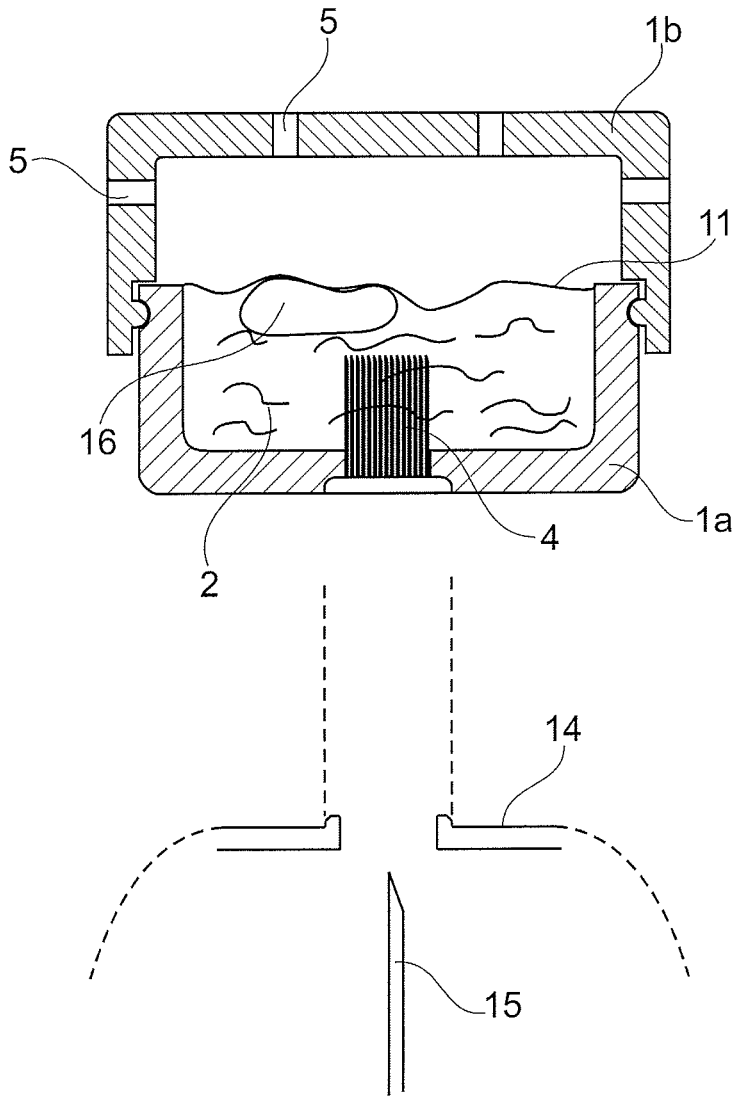
FIG. 8 shows a schematic view of a longitudinal section of another embodiment of the present disclosure.

FIG. 8 shows another embodiment that differs from the embodiment shown in FIG. 7 essentially only in that the porous body 13 was replaced by a wick 4. In order to avoid repetitions in this context, please refer to the description of the embodiments shown in FIGS. 1 to 4.

Figure 9:
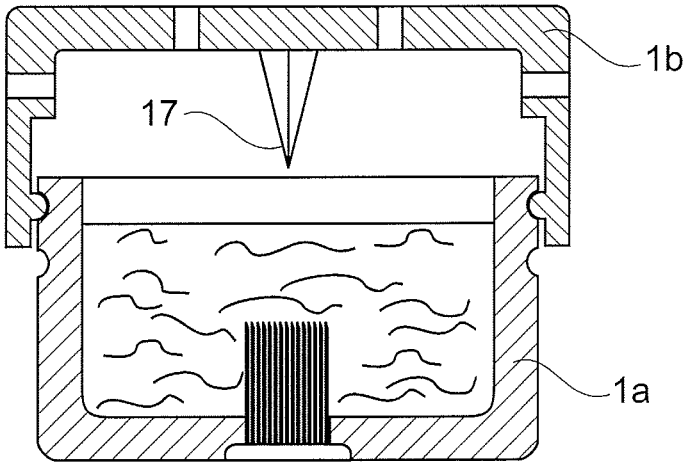
FIG. 9 shows a schematic view of a longitudinal section of another embodiment of the present disclosure.
Figure 10:
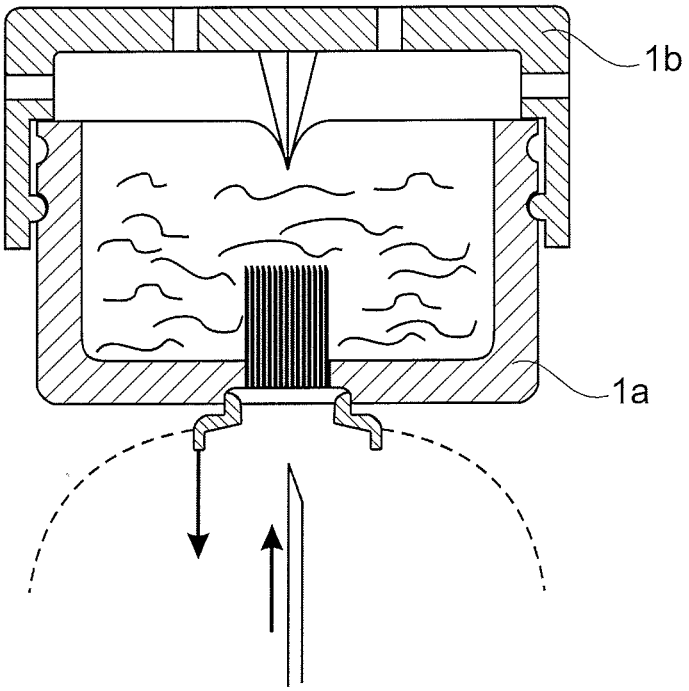
FIG. 10 shows the embodiment of FIG. 9 during the removal of reference solution.

FIG. 9 shows another embodiment that differs from the embodiments shown in FIGS. 7 and 8 essentially in that one container wall shows a mandrel 17 pointing at the membrane 11. The wall elements 1*a*, 1*b* are mobile with respect to each other in this embodiment. Pushing the two wall elements 1*a*, 1*b* together moves the wall element 1*b* with the mandrel 17 towards the membrane 11 such that the mandrel 17 perforates the membrane 11. This is shown in FIG. 10.

If the two wall elements 1*a*, 1*b* are pushed into each other by pressure, the mandrel 17 that is arranged on one of the two wall elements 1*a*, 1*b* perforates the membrane 11. It is preferable in this context for the two wall elements 1*a*, 1*b* to lock to each other in an end position when they are pushed together such that a used container 1 (i.e., a container 1 with perforated membrane 11), is easy to recognize. For clarification, one of the two wall elements 1*a*, 1*b* can comprise a marker, for example a colored ring, that becomes covered when the two wall elements 1*a*, 1*b* are pushed into each other.

Figure 11:
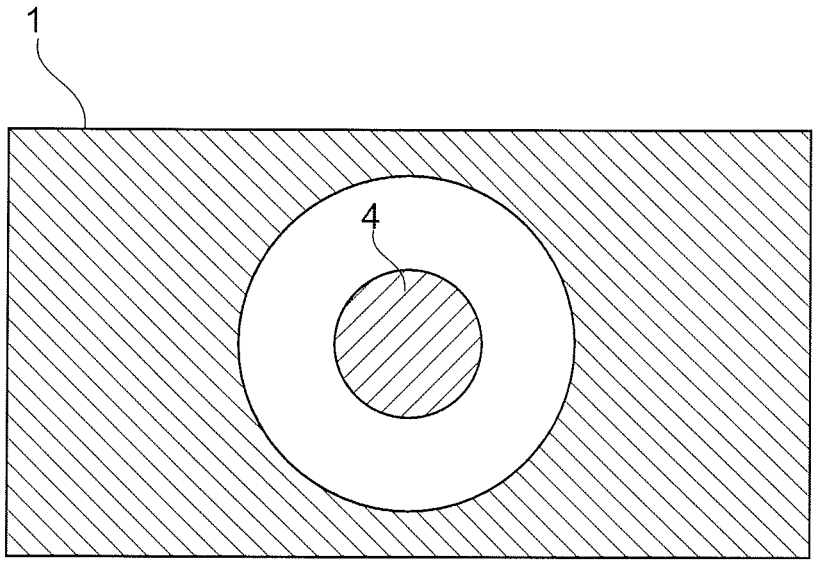
FIG. 11 shows a schematic view of another embodiment of the present disclosure.
Figure 12:
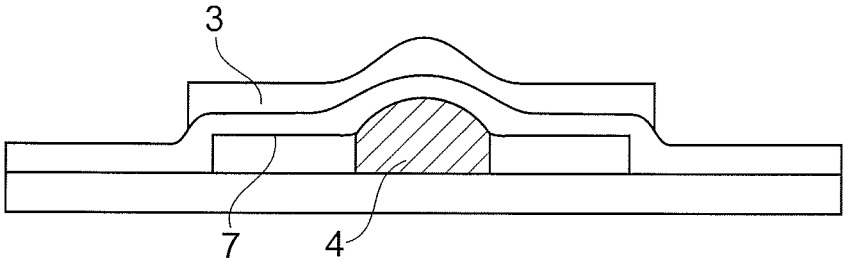
FIG. 12 shows a section with respect to FIG. 11.

FIGS. 11 and 12 show another embodiment of a container 1 containing reference solution. Different from the preceding embodiments described above, the container 1 shown has a relatively thin container wall that may consist, for example, of plastic film. For the container wall to form a stop for touching against a puncturing device for removal of a sample regardless, a ring-shaped disc 7 that surrounds a reference solution-soaked body 4, for example a wick or a sponge, is arranged in the container. For removal of sample, a puncturing device can be used to push against a section of the container wall that is supported by the ring-shaped disc 7 without the liquid pressure in the interior space of the container increasing significantly.

The container shown in FIGS. 11 and 12 can, for example, be a film bag or a blister. A blister is a packaging that consists of a base plate that carries a film/foil such that an interior space of the container is formed between the film/foil and the base plate.

In order to protect a thin-walled upper side of the container shown from damage, the upper side can be covered by a peelable adhesive label 3, for example made of paper or film/foil. For removal, the adhesive label is pulled off the film/foil and subsequently the container wall covering the reference solution-soaked body is perforated by a puncturing element. In this case, the adhesive label forms the removable closure part 3 of the container 1.

Upon suitable packaging of the container 1, it is feasible to dispense with a label 3 of this type for protecting the outlet. The outlet of the container is then the container wall-covered end of the ring-shaped disc 7-surrounded channel, in which the reference solution-soaked body 4 is arranged. The section of the container wall that covers the reference solution-soaked body 4 can be considered to be a closure part in this case.

Figure 13:
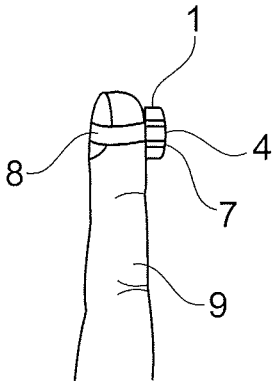
FIG. 13 shows a modification of the embodiment shown in FIG. 11.

In order to render the removal of reference solution from a container like the one schematically shown in FIGS. 11 and 12, as easy as possible for a user, the container can comprise means for positioning on the finger tip, for example an adhesive area or a loop 8, like the one shown schematically in FIG. 13. Since samples of body fluid are usually taken from the finger tip of an extended finger 9 by puncturing device, an attachment of this type allows the motion sequences that are familiar to a user to also be used for the removal of reference solution.

Figure 14:
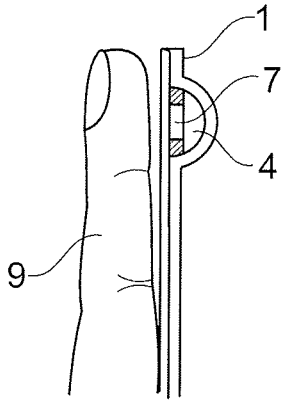
FIG. 14 shows another modification of the embodiment shown in FIG. 11.

In order to allow a user to remove reference solution using familiar motion sequences, the container can also be provided with a longer stem, as is shown schematically in FIG. 14. This is another means for pressing the puncturing device against a container that touches against a finger tip for the removal of reference solution.

While this disclosure has been described as having exemplary designs, the present disclosure can be further modified within the spirit and scope of this disclosure. This application is therefore intended to cover any variations, uses or adaptations of the disclosure using its general principles. Further, this application is intended to cover such departures from the present disclosure as come within known or customary practice in the art to which this disclosure pertains and which fall within the limits of the appended claims.

What is claimed is:

1. A container containing reference solution for clinical chemistry, including:

an outlet for extracting reference solution by puncturing with a puncturing element of a puncturing device;

a closure part covering the outlet;

a wick having a length, the wick being positioned in the container and extending from the outlet such that a majority of the length extends into an interior space of the container to contact reference solution contained in the interior space; and a rigid molded wall that forms a stop that resists pressure exerted on the container by the puncturing device during extraction of a sample of the reference solution;

wherein the rigid molded wall forms a channel extending between the interior space and the outlet, the wick being secured to the channel.

2. A container according to claim 1, wherein the wall surrounds the wick and carries the closure part.

3. A container according to claim 1, wherein the wall is configured to withstand a press-against force of at least 3 N when the puncturing device engages the container during extraction of the sample without reference solution being forced from the outlet.

4. A container according to claim 1, wherein the closure part is connected to the container by a pre-determined breakage zone.

5. A container according to claim 1, further including a pressure compensation channel that is closed by the closure part and extends into the interior space adjacent to the wick.

6. A container according to claim 1, wherein the wick includes a fiber bundle.

7. A container according to claim 1, wherein a majority of the length of the wick touches against the channel.

8. A container according to claim 1, wherein the closure part is removable and the wick is positioned in the container to project from the container, when the closure part is removed, by a distance that is smaller than a width of the wick.

9. A container according to claim 1, wherein the wick includes fibers that are distributed over a cross-section of the wick.

10. A container according to claim 1, wherein the wick immerses into the reference solution, when the outlet faces upwardly.

11. A container according to claim 1, wherein one end of the wick is positioned at the outlet.

12. A container containing reference solution for clinical chemistry, including:

a wick disposed within an interior space of the container in contact with the reference solution contained in the interior space;

a container wall configured to be pierced by a puncturing device upon extraction of the reference solution; and a ring-shaped disc inside the container that surrounds the wick and supports the container wall thereby forming a stop that resists pressure exerted on the container wall by the puncturing device during extraction of the reference solution.

13. A container containing reference solution for clinical chemistry, including:

an outlet for extracting reference solution by puncturing with a puncturing element of a puncturing device;

a closure part covering the outlet;

a wick having a length, the wick being positioned in the container and extending from the outlet; and a container wall that forms a stop that, without deforming, resists pressure exerted on the container by the puncturing device during extraction of a sample of the reference solution;

wherein the container wall forms a channel extending between the interior space and the outlet, a majority of the length of the wick being in contact with the channel.

14. A container containing reference solution for clinical chemistry, including:

an outlet for extracting reference solution by puncturing with a puncturing element of a puncturing device;

a closure part covering the outlet;

a wick having a length, the wick being positioned in the container and extending from the outlet such that a majority of the length extends into an interior space of the container to contact reference solution contained in the interior space;

a container wall that forms a stop configured to resist pressure exerted on the container by the puncturing device during extraction of a sample of the reference solution; and a foil base connected to the container wall and spanning an opening of the container wall.

15. A container containing reference solution for clinical chemistry, including:

an outlet for extracting reference solution by puncturing with a puncturing element of a puncturing device;

a closure part covering the outlet;

a wick having a length, the wick being positioned in the container and extending from the outlet; and a container wall configured to withstand a press-against force of at least 3 N when the puncturing device engages the container during extraction of the sample without reference solution being forced from the outlet;

wherein the container wall forms a channel extending between the interior space and the outlet, a majority of the length of the wick being in contact with the channel.

* * * * *